US006572258B1

(12) United States Patent
Holland

(10) Patent No.: US 6,572,258 B1
(45) Date of Patent: Jun. 3, 2003

(54) APPARATUS FOR MIXING AT LEAST TWO FLOWING MEDIA

(75) Inventor: Klaus Holland, Mitterfels (DE)

(73) Assignee: Holland Kuhlmobel K. & M. Holland GmbH (DE)

( * ) Notice: Subject to any disclaimer, the term of this patent is extended or adjusted under 35 U.S.C. 154(b) by 0 days.

(21) Appl. No.: 09/462,822

(22) PCT Filed: May 11, 1999

(86) PCT No.: PCT/EP99/03228

§ 371 (c)(1),
(2), (4) Date: Apr. 3, 2000

(87) PCT Pub. No.: WO99/58442

PCT Pub. Date: Nov. 18, 1999

(30) Foreign Application Priority Data

May 13, 1998 (DE) ..... 198 21 511

(51) Int. Cl.[7] ..... B01F 3/08; B67D 1/00; B67D 5/56

(52) U.S. Cl. ..... 366/163.2; 366/182.4; 417/186

(58) Field of Search ..... 366/163.1, 163.2, 366/182.4; 417/163, 165, 186, 185, 182, 183, 184, 187; 137/888

(56) References Cited

U.S. PATENT DOCUMENTS 1,415,506 A * 5/1922 Schanes
1,421,842 A * 7/1922 Schmidt
1,583,090 A * 5/1926 Ostermann
1,583,363 A * 5/1926 Ostermann
2,707,021 A * 4/1955 Harris
2,888,191 A * 5/1959 Neuman et al.
2,992,084 A * 7/1961 Schropp
3,357,598 A 12/1967 Kraft
3,689,237 A * 9/1972 Stark et al.
3,727,640 A 4/1973 Sargeant ..... 137/604
3,891,353 A * 6/1975 Templeman ..... 417/185
4,395,201 A * 7/1983 Bron ..... 417/186
4,552,286 A 11/1985 Kuckens et al. ..... 222/145
4,673,006 A * 6/1987 Speck
4,807,783 A 2/1989 Van Zijverden ..... 222/129.2
4,817,825 A 4/1989 Freese ..... 229/129.2
5,452,955 A * 9/1995 Lundstrom ..... 366/163.2
5,466,063 A * 11/1995 Poyet et al. ..... 366/163.2
5,951,922 A * 9/1999 Mazzei ..... 366/163.2
6,162,021 A * 12/2000 Sarshar et al. ..... 417/186
6,270,321 B1 * 8/2001 Schulte ..... 417/186

* cited by examiner

*Primary Examiner*—Tony G. Soohoo
(74) *Attorney, Agent, or Firm*—Fish & Richardson, P.C.

(57) ABSTRACT

The invention features an apparatus for mixing water and a beverage concentrate that includes a first passage channel passing through a housing from an inlet to an outlet, a second passage channel ending downstream in a smaller passage cross-section of the first passage channel, at least one bypass channel connected to the first passage channel, and a means for setting the passing amount of the water or the beverage concentrate.

18 Claims, 2 Drawing Sheets

APPARATUS FOR MIXING AT LEAST TWO FLOWING MEDIA

The invention relates to an apparatus for mixing two flowing media, for mixing water and beverage concentrate or the like in particular, with a first passage channel passing through a housing from an inlet to an outlet and at least one second passage channel ending in said first passage channel, wherein a first medium, a fluid in particular, flows in said first passage channel and a second medium, a fluid in particular, flows in said second passage channel.

Mixing apparatuses of the above-mentioned kind are used for mixing beverages in particular, in that a concentrate, e.g. a fruit juice concentrate, is added to the basic liquid water in a given mixing ratio short before serving the beverage. The water can be conditioned, e.g. enriched with mineral substances or carbon dioxide, or cooled beforehand or can be taken directly from the water mains, wherein it is supplied with standard water pressure of appx. 1.5 to 2 bars to the apparatus for mixing.

For the production of such mixed beverages from concentrated liquid and water the use of a mixing apparatus is known which is passed by water in the manner of a Venturi nozzle and sucks in a concentrate from a bore merging at a right angle. By sucking-in of the concentrate, a concentrate/water mixture is obtained on the outlet of the apparatus. The mixing ratios in this mixing apparatus, however, can only be adjusted by different cross-sections of the channels, i.e. the mixing apparatus must be exchanged for making available another mixing ratio. This is very expensive, as high demands to hygienics are set for delivery of beverages.

Furthermore, in the known mixing apparatus the problem arises that the minimum cross-section of the channel for the concentrate is limited, if concentrated fruit juice containing fruit pulp is to be mixed, As the fruit pulp pieces have to fit through the cross-section in order not to block it, said cross-section must have a certain minimum size. This, however, results in that in traditional mixing apparatuses such fruit juice cannot be made available in low concentration.

A further problem in the known mixing apparatuses lies in that the concentrates may have different viscosities or viscidity which also is influenced by the different ambient temperatures in particular, such that different mixing ratios are obtained in case of different conditions. In the known mixing apparatuses there is no possibility for simple and cheap regulation of the mixing ratio.

The invention, therefore, is based on the object of improving an apparatus of the kind cited in the beginning such that the mixing ratio between two flowing media, between water and a beverage concentrate in particular, can be adjusted in simple manner, wherein this is to be possible independently from the concentrate composition, i.e. containing few or many solid matter portions, with high or low viscosity or the like. Furthermore, the mixing apparatus is to be manufacturable in cheap manner and guarantee safe function also in intermitting operation.

This object is solved in advantageous manner in that at least one by-pass channel to said first passage channel and a means for setting the passing amount of said first and/or second fluid is provided for. In this manner, an arbitrary mixing ratio for the two fluids can be set in simple manner independently from the viscosity and/or the problem, respectively, the fruit pieces are contained in the concentrate. In particular, the second passage channel merging into said first passage channel can have a comparatively large cross-sectional are so that the solid matter particles of the beverage concentrate can uninhibitedly flow through the cross-section, as the mixing ratio only in limited manner depends on the cross-section of the second passage channel. For setting the mixing ratio the mixing apparatus need not be exchanged, so that when changing the mixing ratio no hygienic problems due to the use of a new apparatus are created either. If another concentrate is to be used with the same apparatus, the apparatus due to its simple construction can also be easily cleaned, this being dealt with lateron.

In preferred embodiment of the invention, by the means for setting the passing amount either the passing amount of the first fluid and/or or the second fluid can be adjusted. As in beverage mixtures said first fluid mostly is formed by water and the main portion of the mixture consists of water, the mixing ratio can be varied in a very broad area. Preferably, therein the passing amount of said first fluid is adjustable using the bypass channel and/or bypass channels, so that one could do without a setting means in the merging area of the second passage channel in said first passage channel. The junction could therefore be built in constructively simple manner, while the mixing ratio in practice is regulated over the bypass channels directly. When said second passage channel enters said first passage channel essentially perpendicularly, in the area of entry defined and calculable flow conditions are provided for which are similar to those in Venturi nozzles. In advantageous manner, however, also in the second passage channel a setting means can be provided for which permits fine adjustment of addition of concentrate in particular then if concentrates with low or no solid matter portion, e.g. tee, lemon concentrate or the like, are used.

In further preferred embodiment of the subject matter of the invention it can be provided for that said first passage channel comprises an entry region a central section and an exit region, said central section having a smaller passage cross-section than said entry region and said exit region. In this way it is achieved that in said central section an increased flowing velocity prevails. Said central section therein is made very short as compared to said entry region and said exit region, wherein it e.g. has an extension of only 1.5 to 2 mm, whereas said entry region can amount to approximately 25 mm and said exit region—to approximately 40 to 50 mm. In said entry region in addition a relief chamber is formed in which essentially equal pressure is prevailing. Thereby, variations in pressure and/or in the passing amount of the first fluid, respectively, can be balanced. In the area of its free end said first passage channel preferably comprises an increasingly widening cross-section, this slowing down the initial acceleration of the flow and thus reducing formation of whirls.

Said second passage channel through which the beverage concentrate is supplied preferably enters downstream of said small passage cross-section and essentially perpendicularly into said first passage channel. The junction is located comparatively close to said central narrowed section of said first passage channel such that fruit juice concentrate is entrained by the accelerated water flow and, therefore, no supply of concentrate under pressure is required.

In order to be able to dose the mixing ratio, the bypass channel or channels extend from the entry region of said first passage channel to the exit region and have an essentially constant cross-section. They extend in parallel to the central section of said first passage channel, with its upstream end entering the relief chamber and with its downstream end with a distance to the jonction of said second passage channel entering into the exit region of said first passage channel. Therein, the jonction of each bypass channel is arranged with sharp angle to the axis of said first passage channel and is formed by a piercing bore which has a cross-section narrowing like a nozzle. In same manner the jonction of said second passage channel into said first passage channel can be formed. For setting the passing amount of the fluid through the bypass channels and/or said second passage channel, respectively, dosing means can be provide for which are insertable into the jonction openings. Said dosing means in advantageous manner can be formed by pins which are formed with a tip adapted for being seated in the jonction opening and which are guided in cross bores adjustably by means of a fine thread. By means of the dosing means by which the opening cross-section of the bypass channel or the bypass channels as well as the opening cross-section of said second passage channel can be regulated, the mixing ratio can be arbitrarily set in simple manner. Even if the passage cross-section of said second passage channel has to be opened essentially fully for permitting passage of a larger fruit pulp amount, dosing is possible without problems through the adjustable bypass channels by accurately controlling the passing amount through the respective bypass channel.

In order to manufacture the mixing apparatus as favorable in terms of costs as possible, the housing of said mixing apparatus preferably is made from plastic material and is formed as one-piece injection-molded body. The housing can comprise a fixation means and in the area of the free channel ends connecting necks for connection of connecting hoses, concentrate reservoirs, fluid inlets and/or the like. The connections therein can in known manner be formed as rapid action coupling connections which interlock with respective grooves of the housing and whose connection can be sealed by an O-ring seal e.g. It also is conceivable that in the hose connections closing means are provided for which close the flow to the connecting end of the hose before a corresponding flowing connection to the apparatus in accordance with the present invention is established. Additional closing means can be formed at the inlet side of the apparatus itself for preventing backflows from one channel into another channel.

Further features, details and advantages of the invention result from the following description of a preferred embodiment of the apparatus in accordance with the present invention with reference to the drawing. In the drawing.

Figure 3:
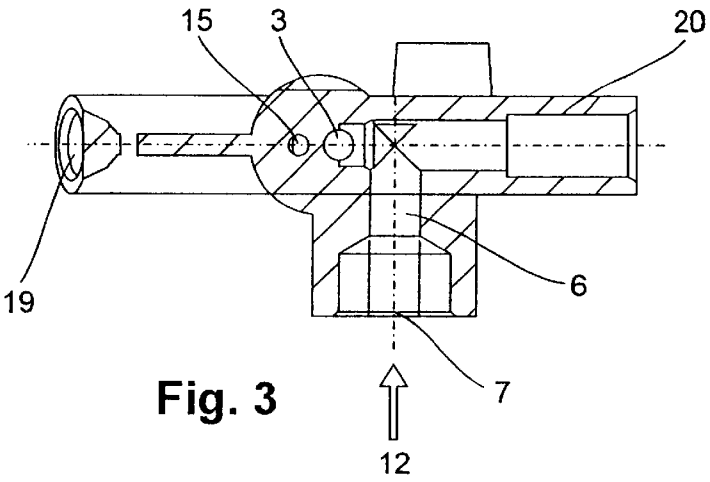
FIG. 3 is a cut view in direction of line B—B of FIG. 1.
Figure 1:
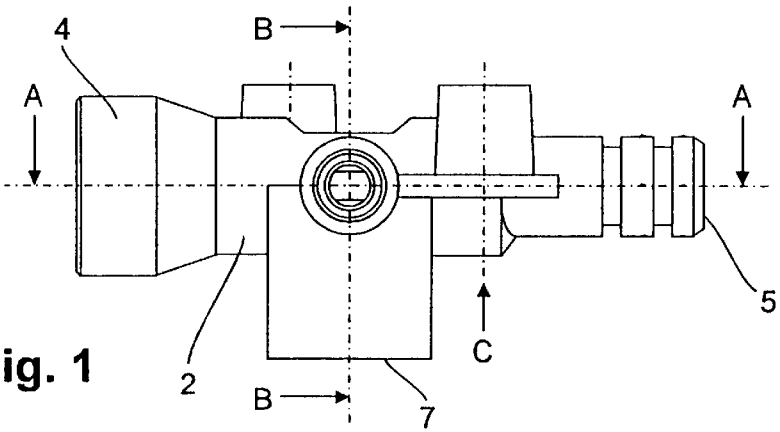
FIG. 1 shows a side view of the apparatus in accordance with the present invention.

The apparatus 1 in accordance with the present invention for mixing at least two flowing media comprises a housing 2 which in the shown embodiment is manufactured as one-piece injection-molded housing made from plastic material.

Said housing comprises a first passage channel 3 with an inlet 4 and an outlet 5 as well as a second passage channel 6 with an inlet 7 and an outlet 8.

Figure 2:
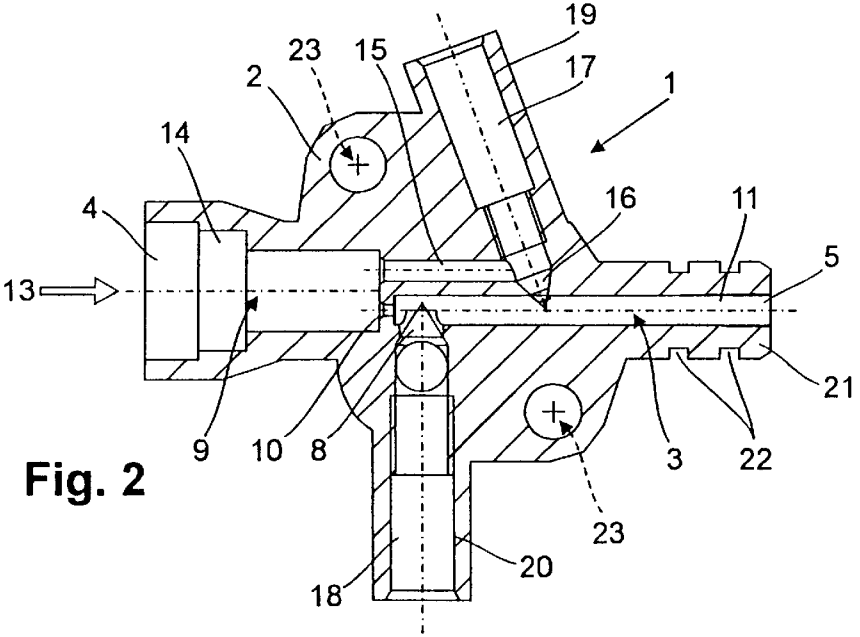
FIG. 2 is a horizontal cut view along the line A—A of FIG. 1.
Figure 5:
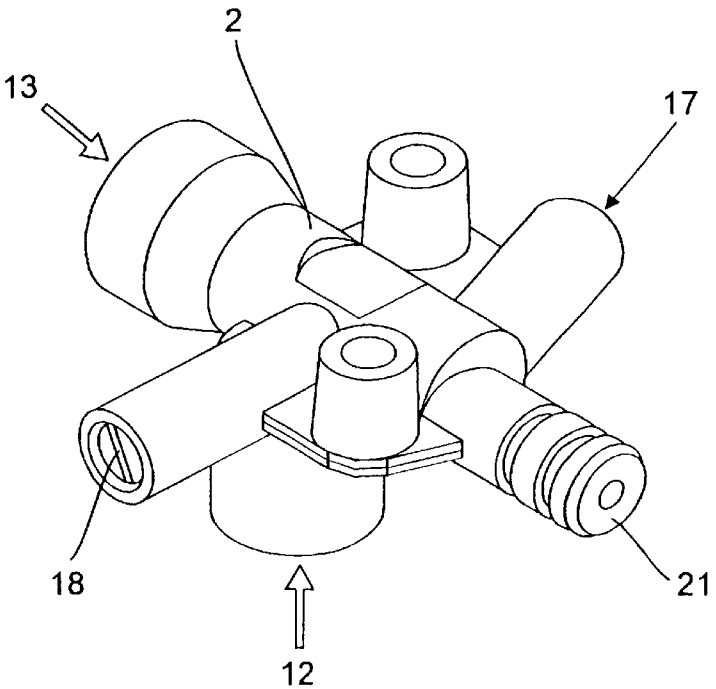
FIG. 5 is a simplified perspective view of the apparatus in accordance with the present invention.
Figure 4:
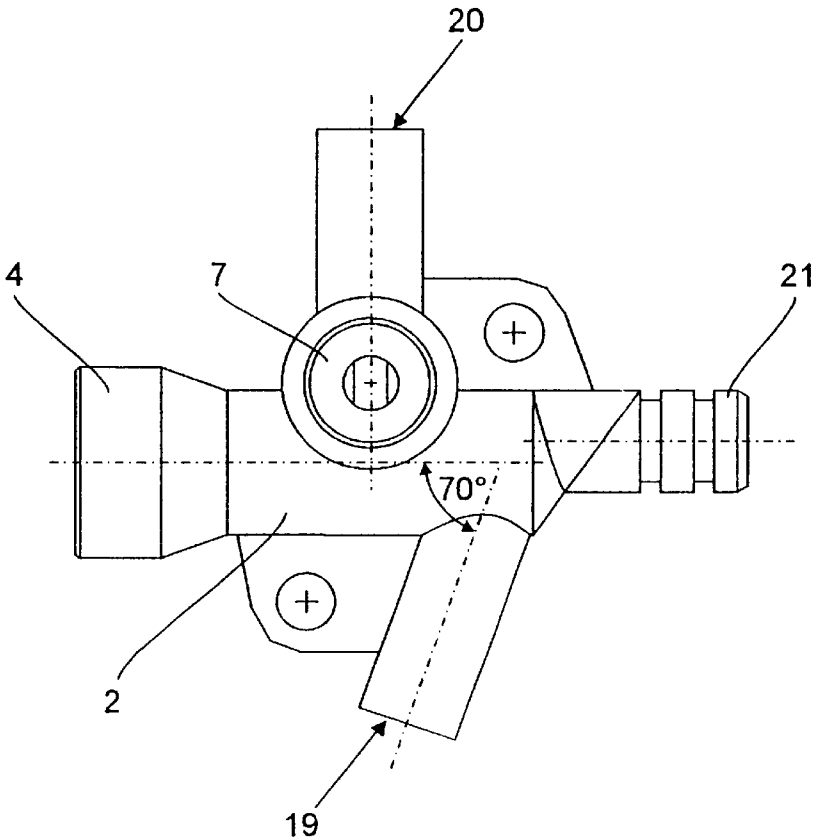
FIG. 4 is a view in direction of arrow C in FIG. 1.

As can be seen from FIG. 2 in particular, said passage channel 3 comprises an entry region 9 with enlarged cross-section, a central section 10 with substantially reduced cross-section and an exit region 11. Said central section 10 is made comparatively short as compared to said entry region 9 and said exit region 11 and cares that the water supplied under pressure in direction of arrow 13 is substantially accelerated in said central section 10 in order to entrain concentrate supplied from the outlet 8 of said second passage channel 6 in direction of arrow 12. In the area of the outlet 8 therein substantial whirls are created and consequently good mixing of water and concentrate is achieved.

In FIG. 2 it can further be recognized that in said entry region 9 a relief chamber 14 is provided for in which an essentially equal pressure is prevailing so that pressure variations in the pressure and/or in the passing amount of the water 13, respectively, can be balanced.

As can further be seen from FIG. 2, said passage channel 3 at its free end in the area of the exit comprises a conical extension contributing to slowing down of the flow of the mixture.

A bypass channel 15 having a cross-section being constant but smaller than said passage channel 3 extends in parallel to said passage channel 3. Said bypass channel with its upstream end ends in the entry region 9 and with its downstream end ends in a piercing bore 1 6 which again ends with a sharp angle in the exit region 11 of said passage channel 3. This provides the advantage that by said bypass 15 the flow of water is given a direction which is directed in flowing direction of the water flow through said passage channel 3 so that whirls are almost avoided. Thereby, a backflow of fruit pulp particles to the central section 10 can be advantageously prevented so that no obstructions can occur.

It is true that in the drawing only one bypass channel 15 is shown, but it is conceivable that several channels are provided for. It further can be seen from FIG. 2 that the junctions of the bypass channels and said second passage channel 6 into said first passage channel 3 are formed like nozzles or truncated cones so that they can form seats for pins 17, 18 which can be screwed in by means of fine threads into housing bores 19, 20 to such extent that the junctions can be closed. In this way said pins 17 and 18 form dosing means through which the entry amount of water through said bypass 15 and/or of concentrate through said channel 6, respectively, is adjustable. In this manner very fine dosing of the mixing ratio can be achieved.

For the operation of the mixing apparatus in accordance with the present invention said second passage channel 6 in the region of its inlet 7 is connected to a concentrate bag, preferably in the manner of a plug-in cartridge or by means of a snap connection so that no particular sealing of the connection must be effected. The inlet 4 is connected to a water supply in the same manner and a tube or a hose is slipped over the connecting neck 21 for transferring the mixed liquid to the desired position. Sealing of the tube or the hose, respectively, therein is effected in simple manner via a snug fit which can additionally be secured using hose clamps or the like which press the hose into the grooves 22.

When the user wants to take out a certain amount of the mixed liquid, he actuates a corresponding lever or pressure means this permitting supply of water and concentrate to the mixing apparatus. In simple manner therein magnetic valves can be provided for opening and closing the supply. As soon as water 13 flows through said inlet 4 into said entry region 9, it has to pass the narrowed bore of said central section 10 and thereby is accelerated substantially. Depending on the setting of said pin 17, the water enters said first passage channel 3 through said central section 10 and said bypass channel 15. The water flowing through said central section 10 after short path arrives at said outlet 8 of said second passage channel 6 through which the concentrate is supplied. Due to the small cross-section of said central section 10 and the high flowing velocity of the water the concentrate from said second passage channel 6 is entrained and guided to outlet 5. The water from said bypass channel 15 or said bypass channels also reaches said exit region 11 of said first passage channel 3 where it mixes with the mixture out of water and juice concentrate. The mixture thus obtained then is taken out by the user. It also is possible to subsequently rinse said central section 10 a certain period at the end of the taking-out operation in order to remove concentrate rests from the mixing apparatus. The mixing apparatus then can be used for another concentrate, a finely dosed mixture being obtainable in the same manner.

For setting the mixing ratio, said pins 17, 18 contained in the cross bores 19 and/or 20, respectively, are turned such that they respectively are inserted into or removed from said bypass channel or said passage channel 6 for the concentrate. In this way the mixing ratio can be adjusted within a wide range using simple mechanical measurements. Thus, e.g. mixing ratios of 1:1 to 1:100 can be produced, e.g. for ice tea of 1:20, for orange juice of 1:5, wherein a water pressure of 1.5 to 2 bars is used. Therein an amount of 2,5 l/min related to the shown diameter conditions of the embodiment is the result. In case of larger desired amounts the diameters can be enlarged correspondingly. The mixture is stable independently from different water pressures as the suction is proportional to the water pressure.

What is claimed is:

1. An apparatus for mixing water and a beverage concentrate, said apparatus comprising:

a first passage channel comprising an entry region, a central section and an exit region, said central section having a smaller passage cross-section than said entry region and said exit region, said first passage channel passing through a housing from an inlet to an outlet and said central section being made short as compared to said entry region and said exit region;

a second passage channel ending downstream in the smaller passage cross-section of said first passage channel, wherein the water flows in said first passage channel and the beverage concentrate flows in said second passage channel;

at least one bypass channel extending from said entry region of said first passage channel to said exit region; and a means for setting the passing amount of at least one of the water and the beverage concentrate.

2. The apparatus as defined in claim 1, wherein in said entry region (9), a relief chamber (14) is formed.

3. The apparatus as defined in claim 1, wherein said exit region (11), at least in the area of its free end, comprises an increasingly widening cross-section.

4. The apparatus as defined in claim 1, wherein said second passage channel (6) ends essentially perpendicularly, to said first passage channel.

5. The apparatus as defined in claim 1, wherein the bypass channel comprises an essentially constant cross-section.

6. The apparatus as defined in claim 5, wherein the bypass channel (15) extends in parallel to said central section (10) of said first passage channel (3).

7. The apparatus as defined in claim 1, wherein said bypass channel with its upstream end ends in a relief chamber and with its downstream end ends into said exit region of said first passage channel with a distance to a junction of said second passage channel.

8. The apparatus as defined in claim 7, wherein a junction of said bypass channel into said exit region of said first passage channel is formed by one piercing bore respectively, each extending with a sharp angle to the axis of said first passage channel.

9. The apparatus as defined in claim 8, wherein said junction of said bypass channel includes junction openings which have a cross-section narrowing like a nozzle.

10. The apparatus as defined in claim 9, wherein said means for setting the passing amount of at least one of the water or the beverage concentrate comprises dosing means which are insertable into the junction openings.

11. The apparatus as defined in claim 10, wherein said dosing means are formed by pins which are guided in cross bores and which are adjustable by means of a fine thread.

12. The apparatus as defined in claim 10, characterized in that said second passage channel (6) essentially perpendicularly ends in said first passage channel (3) downstream of said smaller passage cross-section (10) through said cross bore (20) of said dosing means.

13. The apparatus as defined in claim 11, wherein said second passage channel essentially perpendicularly ends in said first passage channel downstream of said smaller passage cross-section through said cross bore of said dosing means.

14. The apparatus as defined in claim 1, wherein said housing (2) is made of plastic material.

15. The apparatus as defined in claim 1, wherein said housing (2) is built as one-piece injection-molded body.

16. The apparatus as defined in claim 1, wherein said housing (2) comprises a means for fixing said housing (23).

17. The apparatus as defined in claim 1, wherein said housing (2) comprises connecting necks (21) for connection of connecting hoses, concentrate reservoirs, and liquid supply lines.

18. The apparatus as defined in claim 1, characterized in that the bypass channel (15) extends from said entry region (9) of said first passage channel (3) to said exit region (11), it therein showing an essentially constant cross-section.

* * * * *